United States Patent [19]

Clay et al.

[11] 3,971,437

[45] July 27, 1976

[54] APPARATUS FOR DEWATERING BOREHOLES

[76] Inventors: Robert B. Clay, 728 W. 3800 South, Bountiful, Utah 84010; Lex L. Udy, 4597 Ledgement Drive, Salt Lake City, Utah 84117

[22] Filed: Apr. 21, 1975

[21] Appl. No.: 570,011

Related U.S. Application Data

[63] Continuation-in-part of Ser. No. 531,987, Dec. 12, 1974, abandoned, which is a continuation-in-part of Ser. No. 506,175, Sept. 16, 1974, abandoned.

[52] U.S. Cl. ..... 166/187; 166/311; 277/34; 417/118

[51] Int. Cl.[2] ..... E21B 33/12; F04F 1/06; F04F 3/00

[58] Field of Search ..... 166/314, 311, 105, 106, 166/112, 187, 179; 417/118; 277/34, 34.3, 34.6, 213, 234, 228, 229

[56] References Cited

UNITED STATES PATENTS

| | | | |
|---|---|---|---|
| 656,466 | 8/1900 | Minor | 166/311 |
| 1,513,228 | 10/1924 | Crotto | 166/187 X |
| 1,547,194 | 7/1925 | Arbon | 166/314 X |
| 1,942,366 | 1/1934 | Seamark | 277/34 |
| 2,643,722 | 6/1953 | Lynes et al. | 166/187 X |
| 2,778,432 | 1/1957 | Allen | 166/187 |
| 3,338,310 | 8/1967 | McGill | 166/187 X |
| 3,529,667 | 9/1970 | Malone | 166/187 X |
| 3,604,732 | 9/1971 | Malone | 166/187 X |
| 3,746,097 | 7/1973 | Mott | 166/187 X |
| 3,764,235 | 10/1973 | Bittermann | 166/187 X |

*Primary Examiner*—Stephen J. Novosad
*Assistant Examiner*—George A. Suckfield
*Attorney, Agent, or Firm*—Edwin M. Thomas

[57] ABSTRACT

A simple dewatering system comprises hollow expandable bore-plugging body which can be set in place and locked there in the borehole, at any desired level, by simply pumping compressed air into it. An orifice of calculated size in the bottom of the body allows compressed air to escape and build up pressure below to raise the water in the lower part of the hole to the ground surface through a conduit which extends from the borehole bottom to a level above the ground. The orifice, which may be adjustable, maintains a predetermined minimum pressure differential inside the body which pressure is enough higher than the water-expelling pressure below to keep the body tightly inflated so it cannot slide upwardly. Compressed air escapes continuously through the orifice so that outflow of water from the borehole bottom is continuous until the water level reaches the bottom of the outflow conduit, when the conduit is blown clear, preventing run-back of the water in the conduit. The body and the outflow conduit may be enclosed in a sleeve or liner of impervious flexible sheet material which lines the inner borehole surface and prevents loss of compressed air through fissures or other pores or openings in the rock formation where the hole is located. To withstand high pressures, a protective shroud of metal mesh is used to limit stretching of the expandable body.

6 Claims, 4 Drawing Figures

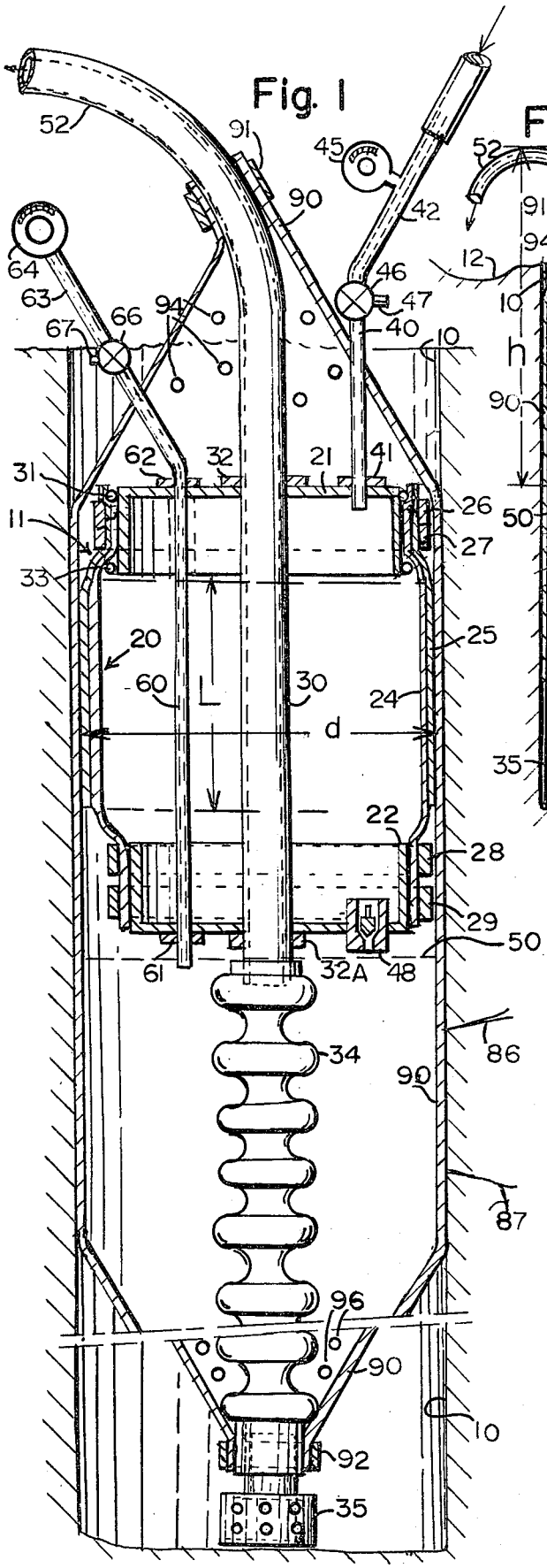
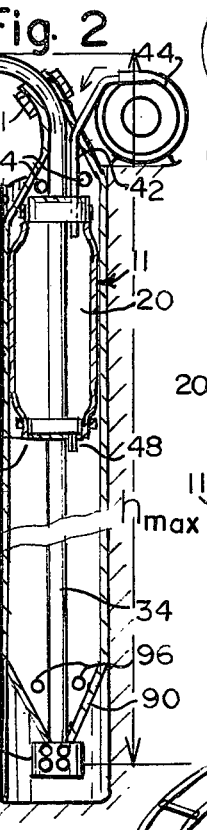
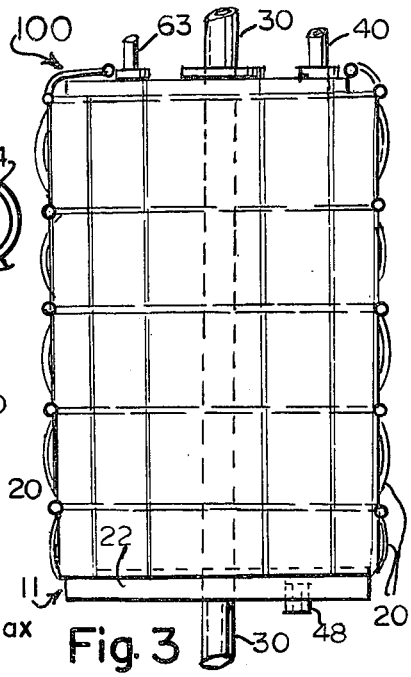
Fig. 3
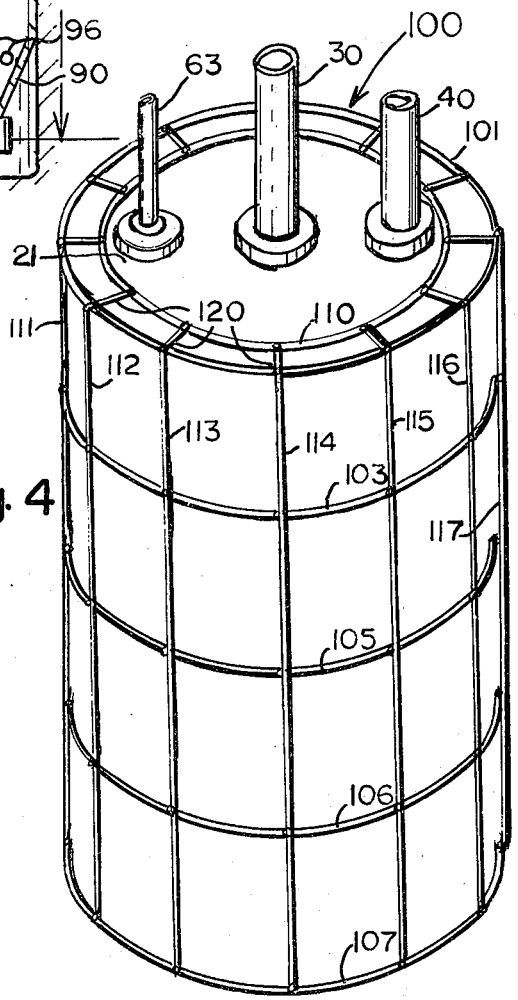
Fig. 4

APPARATUS FOR DEWATERING BOREHOLES

The present application is a continuation-in-part of an application under the same title, Ser. No. 531,987, filed Dec. 12, 1974, now abandoned, which in turn is a continuation-in-part of Ser. No. 506,175, also filed by the present inventors on Sept. 16, 1974, now abandoned.

BACKGROUND AND PRIOR ART

Large scale operations involving massive rock-blasting for mining and other purposes, in recent years, have led to the use of relatively large and deep boreholes which are filled with blasing agents and set off in groups, sometimes in large numbers. In many cases, these boreholes become filled or partly filed with ground water before they can all be loaded with the explosive materials and set off at proper times. It is desirable, in such cases, to remove all or most of the water before loading, especially when the explosive blasting agents are such as to be adversely affected by water. Various types of pumps and other water lifting devices have been used or proposed for this purpose. Many of these are too heavy, complex or cumbersome for efficient field use.

Some suggestions have been made in the prior art, however, for the use of relatively small and light weight water lifting or ejecting systems. Small submersible pumps are sometimes used but their power lines and the necessary piping or conduits make 101, unhandy. Moreover, their capacity is often quite small or they are too large to use in typical boreholes. In U.S. Pat. No. 3,764,235, to Bittermann, a portable pneumatic device having an inflatable structure and means for driving borehole water through it is described. This deivce is relatively small and comparatively easy to handle for the purpose. It comprises a hollow elastic bore-plugging body which can be set into a borehole and inflated, thus expanding to plug the hole. When the inflating pressure inside the body reaches a predetermined maximum, a pressure relief valve opens, allowing compressed air to escape downwardly to force the water below the body out of the hole through a conduit.

The present invention is an improvement over the type of device just described. It avoids, however, the relative movement between the body ends in the Bitterman device, which tends to dislodge the body from its hole-plugging position. It also avoids the necessity for using complicated parts, such as a pressure relief valve, and it starts putting water-expelling pressure into the lower part of the borehole almost immediately, instead of waiting until the device is fully inflated and until a predetermined pressure is built up inside the body. The device of the present invention also is designed to fully expel the water in the outflow by a sudden expansion or "blow-out", which occurs as soon as the water level in the hole reaches the desired low level. This avoids run-back of water in the line to the hole, which usually occurs when the prior art pumping operations are discontinued. It is, therefore, an object of the present invention to provide an inexpensive apparatus and an efficient method for complete borehole dewatering operations.

Many blasting holes are bored in rock formations which contain fissures, cracks, holes, or porosities such that pneumatic pressure in the hole below the plugging body cannot be maintained on the water column long enough to expel the water effectively. A further purpose of the present invention is to enclose the inflatable dewatering unit in such a way as to close off such leaks.

In deep boreholes, the force required to lift water out tends to push the plugging body upwardly and out of the hole. This demands that the body be anchored sufficiently firmly that such lifting cannot occur and a further object of the present invention is to so design the body that it will be firmly retained against a heavy lifting thrust. This accomplished in part by the design of the body itself and in part by the control of expanding and locking forces generated within the body, as will be further explained. Those parts of the body that engage the borehole sidewalls by friction are made preferably of materials which have high coefficients of friction against rock, including wet, slimy and dirty rock. By fixing the upper and lower ends of the plugging body or "pump body", as it may be called, so that there is relatively no movement between these ends, and by making the longitudinal gripping surfaces as long as convenient, and/or as effective as possible in gripping the borehole walls, axially of the borehole, plus the choice of high friction gripping surface materials, this object is achieved.

Another aspect of the invention, includes a reinforcing and preferably flexible cage structure for limiting expansion of the inflatable body within safe limits.

A further feature of the invention involves the design by means of which a complete blow-out of water in the outflow line is accomplished while, at the same time, the borehole is automatically depressured. Thus, the unit can be removed immediately after blow-out and taken to another hole, whereas some of the prior art devices which require set pressure relief valves, etc., must first be deflated in a separate operation before they can be removed and used in another hole.

Further features and objects of the invention will be more fully described and appreciated in the detailed description which follows.

BRIEF DESCRIPTION OF DRAWINGS:

FIG. 1 is a front or elevational view, partly in section, and partly broken away, showing the essential apparatus and its connections.

FIG. 2 is an elevational view, also partly in section, on a smaller scale, showing a typical and somewhat simple installation.

FIG. 3 is a elevational view of a cage or confining structure applied to limit expansion of the elastic wall boreplugging members of FIGS. 1 and 2.

FIG. 4 is a perspective view, on a larger scale, of an encaged expandable body adapted for dewatering holes containing deep columns of water.

DESCRIPTION OF PREFERRED EMBODIMENT

The basic apparatus of this invention is essentially as described in the parent copending applications, Ser. No. 506,175 and 531,987, mentioned above. Referring to FIG. 1 for most details, and to FIG. 2 for a general and somewhat simpler general layout, the apparatus comprises a peripherally expandable main borehole plugging unit or pump body 11, shown inserted to moderate depth in a borehole 10. This main body 11 comprises a more or less cylindrical hollow structure unit having an elastic inflatable peripheral wall structure 20 secured to and supported by relatively fixed and rigid upper and lower circular heads 21 and 22. Each of these heads consists of a flanged circular disc or plate, arranged with its flange extending towards the other head. The heads 21 and 22, and the body itself, except when inflated, is preferably at least slightly smaller in diameter than the borehole in which it is to be used. In some cases, it may be considerably smaller. Preferably, the unit is designed so that it can be used in various holes of somewhat different diameters, so that one designed, for example, to slide into a ten-inch borehole may be expandable to a size large enough to fit an eleven inch or even a twelve inch diameter hole. Obviously, for holes of greatly different sizes, it may be necessary to use units of different sizes.

The heads or end caps 21 and 22 are firmly secured to a rigid more or less centrally located pipe or tube 30 so that there will not be any significant longitudinal shifting under inflating pressure of either head with respect to the other. Air tight sealing collars or gaskets 32 and 32A are provided to prevent leakage of air or other fluid around the tube 30 where it passes through the end caps. This rigid structure also prevents movement of the heads away from each other and hence there is no undesirable stretching of the side wall structure longitudinally of the borehole when the body is inflated. Where the heads can shift away from each other under inflation, incipient slipping along the walls occurs which can result in the whole unit being blown out of the hole.

The peripheral wall structure 20 preferably comprises a main inner flexible and distendable elastic tube 24, of innertube grade rubber or similar material, having a rather high coefficient of friction. This tube is firmly secured at top and bottom to the heads or caps 21 and 22 means of clamping bands or rings 26, 27 and 28, 29, respectively. Since sharp and jagged rock edges may be encountered sometimes in boreholes, it is preferred to enshroud the tube 24 in a wear resistant outer cover 25. The latter may be of the same material as the inner tube 24 or it may be a rubber impregnated and/or coated sheet of tough fabric having similar high coefficient of friction characteristics in its outer surface.

When the device of FIG. 1 is used in a closely fitting borehole, it can be inflated to a relatively high pressure without danger of bursting. The same is true of the device of FIG. 2 which is simpler but similar in most fundamental respects. At very high pressures, on the other hand, or when used in boreholes of considerably larger diameter than the uninflated body 20, there may be danger of bursting. To prevent this a mesh or cage structure may be needed, as seen in FIGS. 3 and 4. These will be described more fully below.

For holding the peripheral wall or membrance material 24 securely, special beads 31 and 33 may be used as shown at the upper head 21, FIG. 1. In some cases difficulty may be encountered, due to the peripheral walls or membrane tending to pull loose from the caps 21, 22 and holding clamps 26, 28, etc. A ring or wire band 31 is securely fastened to the upper peripheral edge of the cap 21, as be welding, and a similar ring or wire band 33 is similarly fastened around the lower peripheral edge of the cap flange or skirt 33. A similar arrangement may be used at the lower cap 21. The upper peripheral margins of the wall membrane members 24 and 25 are clamped between these rings by the tension ring clamps 26 and 27. Two such ring clamps are shown at top and at bottom but in some cases a simple ring at either end will suffice, as will be obvious.

Such a structure may be useful particularly when the body 11 is considerably smaller in diameter than the borehole to be plugged; they are useful in any circumstances where considerable pressure and high resulting tension is applied to the peripheral membrane.

A main function of the peripheral membranes 24 and 25 is to form an air-tight seal against the borehole walls all around so the air pressure to be applied below the body 11 for expelling the water will not be lost by leakage along the borehole wall. An additional function is to engage the walls with sufficient locking friction to withstand the upward thrust on the body 11, which occurs as the borehole below is brought under water-lifting pneumatic pressure. The frictional force that holds the body in place against upward thrust may vary considerably in different boreholes, and may vary at different levels in the same borehole, depending upon such factors as smoothness of the borehole wall, the character of the formation, whether coated with mud, slime, water, or fine dust, etc. Other things being equal, the greater the vertical length of the body 11, or its peripheral elastic wall in contact with the borehole, the greater will be its anchorage against vertical displacement. This will be discussed further below.

How well the bore hole is sealed around the body, and below it as well, will vary also with such factors as smoothness of the borehole wall, its porosity, the presence of cracks, fissures, etc., in the formation, and the extend to which the elastic wall 24 or 25 can conform in detail to the borehole wall surface. In some boreholes, porosity or air leakage out of the hole or around the body 11 may be so excessive that supplemental scaling means must be provided. One feature of this invention not disclosed in the first copending application, Ser. No. 506,175, is the use of an outer envelope or film of flexible material to enclose the whole pump body.

Attached to the lower end of pipe 30 is a flexible, non-collapsing hose or foot-pipe 34. Preferably this is in the form of a longitudinally extensible corrugated hose, suitably reinforced internally to prevent its collapse under applied external pressure. The lower end of this hose or foot-pipe 34 is attached to a perforate rock guard screen or foot piece 35 which will allow water to flow into the tube 34 while excluding pieces of rock or other foreign matter which otherwise might block the conduit or cause other damage.

At its upper end, the pipe or tube 30 is connected to an outlet pipe or hose 52 for conducting water out of the borehole to a point of disposal, e.g., to a pond or trough 12, FIG. 2.

Compressed air is supplied to inflate the body 11 and to apply lifting pressure on the water in the borehole below through a line 40 attached to and passing through the upper cap or head member 21. Tube 40 is hermetically sealed to the cap member by a sealing element 41. An air hose 42 connects line 40 to a source of compressed air, such as a compressor 44, FIG. 2. Obviously, a pressured tank or other supply of air, or of other gas, may be substituted for the compressor. Conventional means, not shown, may drive the compressor. A pressure gauge 45 is attached to the connecting tube 40 for observing the pressure applied to inflate body 11. While not essential, it is convenient also to have a three-way valve 46 installed in line 40, this valve having a side outlet 47 for adjusting or controlling air flow into the body of the pump and/or for blowing off or releasing pressure in the body 11 if this should be required for any reason, e.g., to move the unit up or down in a hole. The gauge and the valve may be dispensed with in many cases, e.g., if it is desired to keep the system simple and inexpensive.

The lower end of the body, cap 22, contains a sized or adjustable orifice element 48 so arranged as to maintain within body 11 a differentially higher gas pressure than that in the borehole below. The pressure differential, of course, depends on the flow rate. This is an improvement over the use of a pressure relief valve. It makes certain that the elastic wall structure 20 will be firmly expanded against the borehole walls, to hold the unit in place, before substantial thrust pressure from below tends to push the device out of the hole. At the same time, it permits gas pressure below to begin building up without waiting until it becomes high enough, within body 11, to open a valve.

As shown in FIG. 1, a small tubular line for monitoring pressure below the pump body extends through the lower cap member 22, to which is is securely sealed by a seal element 61, this line 60 also passing through the upper cap 21, sealed at 62 to prevent leakage, and being connected by a line 63 to a pressure gauge 64. This line also contains a relief valve 66 having a side outlet 67. This valve and outlet may be used, if desired, to blow-off pressure when a pumping operation is completed or for relocating the device at a different level in the same borehole, as may sometimes be necessary. Line 60 and the elements connected thereto are not always necessary but are often a convenience.

Obviously, when compressed air (or other gas) is supplied through line 40 to body 11, pressure within the body first tends to inflate the elastic peripheral walls 24, 25, and to lock the device in place within the borehole. Immediately, also, the pressure begins to build up, gradually, on the water in the borehole below. As a result, the initial level of water, shown at 50 by way of example, starts moving downwardly as soon as pressure is applied while water flows into line 34, 30, 52 through the foot piece or rock-guard screen 35. This water rises in the outflow line until it reaches the top and soon begins to be discharged to the trough or disposal point 12, as previously mentioned. As the water rises in line 34, 30, etc., the back or upward pressure on the pump body 11, which tends to push this body out of the hole, continues to increase until actual discharge begins. However, the orifice 48 continually maintains a higher pressure within the body than the pressure below it as long as inflating and lifting gas is flowing into body 11; consequently the expanding force against the side wall increases or is maintained to keep the device tightly locked in place, despite the increasing force from below which tends to eject the device from the hole. This action is superior to that of the prior art system using a pressure actuated relief valve because, in the present invention, the holding force, due to the inflation pressure, is substantially proportional at all times to the thrust force from below.

For starting up, the pump body 11 may be held down manually until a little pressure builds up inside it, to hold it in place in the borehole. It is to be emphasized that the orifice 48 should never permit the gas outflow rate, from the bottom of the body 11, the exceed the normal rate of gas flow into the body from the compressor or other source.

Most natural rock is porous to some degree and in some cases the porosity of the borehole side wall can cause serious problems. Compressed gas may be lost as fast as it can be supplied in some cases. As water is expelled from the borehole, more and more of the side wall, the porous rock, is exposed. This may bleed off a large part and in severe cases all of the pressured gas below the body 11. In some cases, perhaps in most, this can be dealt with fairly satisfactorily by depressuring the pump and relocating it in the hole at a lower level. This is not always convenient and is not effective in cases where the loss of compressed air or other gas to the formation, as through cracks, crevices, large pores, etc., is excessive. In such cases, the flexible shroud or liner 90, described below may be used. This is a further feature of the present invention.

The shroud or lineras shown in the drawings, FIGS. 1 and 2, surrounds and encloses the pump body and extends to or nearly to the bottom of the borehole. It may be made of any suitable impervious flexible sheet material, preferably in the form of a seamless tube. At its upper end, the tube 90 is gathered and tied around the upper part of the device; it may be clamped around the outflow line 52 as shown at 91. It encloses the pump body 11 and extends on down to or nearly to the bottom of the borehole 10 where its lower end also is gathered around and tied or clamped at 92 to the lower end of the outflow line 34 just above the rock guard screen 35. This is done to make sure that the liner will go all the way down when the assembly is inserted into the borehole.

With this arrangement the shroud or liner hangs at least reasonably close to the borehole side wall and will be forced against it tightly wherever a significant gas leak occurs. Experience has shown that this is a very effective solution for the problem of dewatering boreholes that have high side wall pososity or cracks or crevices, such as are indicated at 87, 88.

The shroud or liner is perforated at or near the top, as shown at 94, to allow gas inside it to escape as the assembly is put into the hole. Other perforations 96 are made at or just above its bottom end to permit water expelling gas from orifice 48 to escape.

As suggested above, there may be situations where excessive tension may be exerted on the peripheral diaphragm member 24, or even on an outer diaphragm 25, as where the borehole and the water column to be lifted are unusually deep. Also, if the borehole is substantially larger in diameter than the device 11, there may be a strong tendency for the internal gas pressure or force to stretch the diaphragms upwardly and outwardly at about the point, for example, where the arrow 11 is shown in FIG. 1. This force is not so likely to cause trouble at the bottom, around head member 22, because it is partly balanced by gas pressure below, but in some cases, the diaphragms 24 and/or 25 have been pulled loose from the clamps 26, 27 or actually torn by pressure from within body 11.

To prevent this, particularly for dewatering very deep holes, a protective mesh cage or wrapper 100, made up of flexible steel cables, chains or the like, is provided. As shown in FIGS. 3 and 4, it comprises an upper circumferential band 10, and a series of spaced and similar horizontal bands 103, 105, 106 and 107 below. A concentric top band 110 is adapted to rest on top of the head 21. Spaced vertical and parallel members 111, 112, 113, 114, 115, 116 and 117 are firmly secured to each of the horizontal rings or bands 101, 103, etc. The top ends of the members 15, 112, etc., converge towards and are secured to the top band 110 at 120. Some of these parts may be flexible wires, if desired, at least in some cases.

With this arrangement, the elastic membranes such as 24 and/or 25, are kept confined in a "coat of mail" so that no large segments can be forced outward and upwardly to form big "bubbles" and burst under the gas pressure from within. The elastic wall members are thus protected against excessive distortion.

In addition, the steel mesh-work elements 101, 103, etc., and 111, 112, etc., tend to embed under applied pressure into the rock walls and improve anchorage in the borehole during water ejection. The cage structure 100 may be lifted off the body 11 when it is not needed, as in dewatering shallower or closer fitting holes.

As already indicated, the orifice 48 in the lower head 22 of carefully predetermined size or flow rate is of considerable importance in this invention. It may be adjustable, within proper limits. The relationships between operating pressure, flow rates and other variables will now be further explained. Mathematically, the force $f_1$ applied from below by gas under pressure, which tends to push the pump body out of the hole, may be represented by the formula $0.434\ h\ \pi d^2/4$ where $h$ is the head of water to be lifted, in feet, and $d$ is the borehole diameter, expressed in inches. Ignoring at least for the moment the weight of the pump and associated parts, which usually is not very great but may be significant, the force $f_1$ must be at least overcome and should be definitely overmatched by the holding force that keeps the device in the borehole. This resisting force, $f_2$, may be expressed mathematically as $pA\mu$, where pressure $p$ inside the body is in pounds per square inch, A is the total contact area between the body and the borehole side wall, and $\mu$ is the coefficient of friction between the two. The contact area A is, of course, the product of the vertical length L of the body 11, and its circumference, $\pi d$, the diameter, both being expressed in inches. Thus, $f_2$ becomes $pL\pi d\ \mu$; the term $\mu$ may be estimated conservatively for most boreholes as not less than about 0.25. Where the cage 100 can be forced into the borehole wall, $\mu$ may be much greater.

To summarize, then, the expelling force $f_1 = p.\ 434h\pi d^2/4$ and the retention force $f_2$ which must always exceed $f_1$, is $pL\pi d\mu$. Typical field values, for an example, may be given. A borehole 40 feet deep and 10 inches in diameter is to be dewatered, using a pressure inside the body 11 of 40 psig. and a value for $\mu$ of 0.25. In this case, $f_1 = 0.434\times40\times100\pi/4$ or $434\pi$; and $f_2 = 40\times20\times10\ \times0.25$ or 2000, giving a safety factor of between 4 and 5, which is quite adequate. In this case it was assumed that L, the height or vertical length of the body 11 is 20 inches or two diameters ($2d$). If the length of the body were cut in half, to $d$ or 10 inches, in this example, the safety factor would be cut in half and this is about the lower safe limit. It is preferred that the length L be two diameters or more, but this is not always necessary.

Also, if the pressure within the body is increased, say to 50 psig., the value of $f_2$ increases, in the example, to $2500\pi$, and force from below is increased somewhat less in proportion, with a factor of safety between 5 and 6. On the other hand, if the internal pressure is decreased to 20 psig., the factor is reduced to only a little more than 2, which is approaching the lower permissible limit. With a higher coefficient $\mu$, of course, the safety factor goes up.

The restrictive orifice 48, which allows air to escape from body 11 to the borehole below must be carefully chosen or set to maintain a safe holding pressure at all times within the body. That is, the rate of air flow through the orifice should never significantly exceed the rate at which air is supplied to the body from the primary source. It may equal the supply rate only when maximum lift of water (from the bottom of the hole) is taking place. Otherwise, the pressure inside the body might drop to an unsafe level, permitting the body to be enjected. If the orifice is made adjustable, care must taken to observe this limitation, for safety reasons. Thus, if the compressor has capacity to deliver to the body 50 cfm. of air under pressure of 100 psig., and pressure inside the body is not to be allowed to drop below 50 psig., the air outflow rate at 50 psig. must not exceed 100 cmf. In other words, the compressed gas supply should be continuous during dewatering. Air flow rates of these magnitudes are within typical limits and are adequate for dewatering most of the holes that will be encountered anywhere. Of course, as soon as "blow-out" occurs, that is, when the bottom water inlet 35 is uncovered by water, the rush of air through the outflow line will clear the line and the hole will then be rapidly depressured. When this occurs, the air supply to the body 11 will be discontinued and/or vented to the outside through valve 46, or otherwise.

It will be obvious that numerous changes and variations may be made in both apparatus and method without departing from the spirit and purpose of the invention. In favorable situations, some of the elements such as shroud 90 and/or cage 100 may be omitted or removed temporarily, but preferably they will always be available. It is intended by the claims which follow to cover the obvious modifications and equivalents as broadly as the state of the prior art properly permits.

What is claimed is:

1. Apparatus for ejecting water from flooding blasting boreholes and the like, which includes an inflatable bore-hole plugging packer body having an upper head, a lower head, and an elastic expansible peripheral wall secured in gas tight relationship to both heads, and having through said upper head an inflating and water-ejecting gas supply line of predetermined gas flow-rate capacity and a rigid water discharge pipe passing through both heads, said apparatus comprising in combination the following improvements:

a. means fixed securing both heads to said rigid discharge pipe so as to prevent relative movement between said heads when said packer body is inflated, b. a predetermined and selectively sized open orifice for restricting gas flow in said lower head, designed to permit continuous gas flow at a rate so controlled that a build-up of pressure will occur in said body as inflating and water-ejecting gas is supplied thereto through said gas supply line sufficient to insure holding of the body by frictional contact with a borehole wall against developing pressure below while permitting a gradual build-up of said developing pressure below to force the water in the borehole into said discharge pipe, said orifice also permitting said gas to flow through said lower head after the borehole water has been forced into the discharge pipe so as to blow water in said pipe completely out of said pipe, and c. a substantially water-impervious borehole liner or membrane secured to said discharge pipe and lining the borehole walls below the packer body so as to substantially inhibit water in the borehole from flowing back into the formation of said borehole walls because of water-ejecting pressure in the borehole.

2. Apparatus according to claim 1 which includes a strong blow-out preventing shroud suspended from said upper head and surrounding said packer body to limit the expansion of said peripheral wall.

3. Apparatus according to claim 2 in which the shroud is formed of reticulate metal meshwork adapted to be pressed into the borehole wall to enhance the anchoring of the packer body in said borehole during water ejection.

4. Apparatus according to claim 1 in which an extensible foot tube member supplements the lower end of the discharge pipe to adapt the apparatus to boreholes of varying depth.

5. Apparatus according to claim 4 in which a screen member is attached to the foot tube to exclude solid matter such as rocks from said foot tube and discharge pipe.

6. Apparatus according to claim 4 in which said borehole liner is attached at its lower end to the lower end of said foot tube.

* * * * *